US009248579B2

(12) United States Patent
DePuydt et al.

(10) Patent No.: US 9,248,579 B2
(45) Date of Patent: Feb. 2, 2016

(54) RAZORS AND RAZOR CARTRIDGES

(75) Inventors: Joseph Allan DePuydt, Scituate, MA (US); Steve S. Hahn, Wellesley, MA (US); John Madeira, Assonet, MA (US); Krassimir Grigorov Marchev, Sudbury, MA (US); Kenneth James Skrobis, Maynard, MA (US); Neville Sonnenberg, Newton, MA (US)

(73) Assignee: The Gillette Company, Boston, MA (US)

( * ) Notice: Subject to any disclaimer, the term of this patent is extended or adjusted under 35 U.S.C. 154(b) by 2236 days.

(21) Appl. No.: 12/174,093

(22) Filed: Jul. 16, 2008

(65) Prior Publication Data

US 2010/0011590 A1 Jan. 21, 2010

(51) Int. Cl.
*B26B 21/00* (2006.01)
*B26B 21/56* (2006.01)

(52) U.S. Cl.
CPC ..... *B26B 21/00* (2013.01); *B26B 21/56* (2013.01)

(58) Field of Classification Search
CPC ..... B26B 21/00; B26B 21/56
USPC ..... 30/50, 346.5, 346.54, 346.57, 346.55
See application file for complete search history.

(56) References Cited

U.S. PATENT DOCUMENTS

| | | | | |
|---|---|---|---|---|
| 1,579,844 | A | | 4/1926 | Smith |
| 3,754,329 | A | | 8/1973 | Lane |
| 3,777,396 | A | | 12/1973 | Simonetti |
| 3,834,017 | A | | 9/1974 | Tolmie |
| 3,834,947 | A | | 9/1974 | Swoboda et al. |
| 3,835,537 | A | * | 9/1974 | Sastri ..... 30/346.53 |
| 3,871,073 | A | | 3/1975 | Nissen et al. |
| 3,911,579 | A | | 10/1975 | Lane et al. |
| 3,949,470 | A | | 4/1976 | Hall |
| 4,044,463 | A | | 8/1977 | Tietjens |
| 4,167,662 | A | | 9/1979 | Steen |
| 4,304,978 | A | | 12/1981 | Saunders |
| 4,473,735 | A | | 9/1984 | Steffen |
| 4,507,538 | A | | 3/1985 | Brown et al. |
| 4,720,918 | A | * | 1/1988 | Curry et al. ..... 30/346.55 |
| 4,980,021 | A | | 12/1990 | Kitamura et al. |
| 4,998,347 | A | | 3/1991 | Schachter |
| 5,263,256 | A | | 11/1993 | Trankiem |

(Continued)

FOREIGN PATENT DOCUMENTS

| | | |
|---|---|---|
| DE | 853397 | 7/1949 |
| EP | 0 191 203 | 8/1986 |

(Continued)

OTHER PUBLICATIONS

PCT International Search Report with Written Opinion in corresponding Int'l appln. PCT/US2009/049908 dated Oct. 12, 2009.

(Continued)

*Primary Examiner* — Omar Flores Sanchez
(74) *Attorney, Agent, or Firm* — Joanne N. Pappas; Kevin C. Johnson; Steven W. Miller

(57) ABSTRACT

Razors cartridges including a guard, a cap, and at least two blades with parallel sharpened edges located between the guard and cap are provided. A first blade defines a blade edge nearest the guard and a second blade defines a blade edge nearest the cap. The first blade has a cutter force less than the cutter force of the second blade.

11 Claims, 6 Drawing Sheets

(56) References Cited

U.S. PATENT DOCUMENTS

| | | | | |
|---|---|---|---|---|
| 5,347,887 | A | 9/1994 | Rosenthal et al. | |
| 5,360,495 | A | 11/1994 | Schuler et al. | |
| 5,488,774 | A | 2/1996 | Janowski | |
| 5,522,137 | A | 6/1996 | Andrews | |
| 5,532,495 | A | 7/1996 | Bloomquist et al. | |
| 5,546,660 | A | 8/1996 | Burout et al. | |
| 5,575,185 | A | 11/1996 | Cox et al. | |
| 5,630,275 | A | 5/1997 | Wexler | |
| 5,822,862 | A * | 10/1998 | Ferraro | 30/50 |
| 5,906,053 | A | 5/1999 | Turner et al. | |
| 6,055,731 | A | 5/2000 | Zucker | |
| 6,077,572 | A | 6/2000 | Hopwood et al. | |
| 6,082,007 | A | 7/2000 | Andrews | |
| 6,156,435 | A | 12/2000 | Gleason et al. | |
| 6,161,287 | A | 12/2000 | Swanson et al. | |
| 6,161,288 | A | 12/2000 | Andrews | |
| 6,178,852 | B1 | 1/2001 | Pfaff | |
| 6,243,951 | B1 | 6/2001 | Oldroyd | |
| 6,289,593 | B1 | 9/2001 | Decker et al. | |
| 6,295,734 | B1 | 10/2001 | Gilder et al. | |
| 6,335,506 | B2 | 1/2002 | Christmas et al. | |
| 6,353,204 | B1 | 3/2002 | Spaay et al. | |
| 6,442,840 | B2 | 9/2002 | Zucker | |
| 6,468,642 | B1 | 10/2002 | Bray et al. | |
| 6,511,559 | B2 | 1/2003 | Brenner et al. | |
| 6,534,131 | B1 | 3/2003 | Domoto et al. | |
| 6,612,204 | B1 | 9/2003 | Droese et al. | |
| 6,684,513 | B1 * | 2/2004 | Clipstone et al. | 30/346.54 |
| 6,962,000 | B2 * | 11/2005 | Teeuw et al. | 30/346.55 |
| 2001/0013174 | A1 | 8/2001 | Zucker | |
| 2001/0015348 | A1 | 8/2001 | Christmas et al. | |
| 2002/0066186 | A1 | 6/2002 | White et al. | |
| 2002/0100522 | A1 | 8/2002 | Benton et al. | |
| 2003/0094077 | A1 | 5/2003 | Hoffman | |
| 2004/0177516 | A1 * | 9/2004 | Teeuw et al. | 30/346.55 |
| 2004/0244539 | A1 * | 12/2004 | Korb et al. | 76/104.1 |
| 2010/0101093 | A1 * | 4/2010 | Avens et al. | 30/50 |
| 2010/0107425 | A1 * | 5/2010 | Bykowski et al. | 30/346.55 |

FOREIGN PATENT DOCUMENTS

| | | |
|---|---|---|
| EP | 0 640 693 | 3/1995 |
| EP | 0 724 507 | 9/1999 |
| EP | 0 850 126 | 1/2001 |
| GB | 1 465 697 | 2/1977 |
| JP | 60165319 | 8/1985 |
| JP | 60258416 | 12/1985 |
| JP | 04263020 | 9/1992 |
| WO | WO 94/26476 | 11/1994 |
| WO | WO 2004/112986 | 12/2004 |
| WO | WO 2007/110821 | 10/2007 |
| WO | WO 2007/110848 | 10/2007 |

OTHER PUBLICATIONS

Report No. 3677/10024, O. D. Oglesby, 'Beard Hair Response to Applied Forces', 27 Pages, 11 Figures, 3 Tables, 3 Plates, dated Apr. 12, 1995.

* cited by examiner

RAZORS AND RAZOR CARTRIDGES

TECHNICAL FIELD

This invention relates to razors and more particularly to razor cartridges and even more particularly to the razor blades in the razor cartridges.

BACKGROUND

In shaving, it is desirable to achieve a close shave, while also providing good shaving comfort. Factors that affect shaving performance include the frictional resistance between the blade edge and the skin and the cutter force applied by the blade to the hair.

It is desirable to provide a razor cartridge having a plurality of razor blades contained therein each of which has a sharpened edge. The sharpened edge reduces the cutter force of the blade as it engages the hair thereby improving shaving comfort. However, it has been found that when using blades with low cutter force in a cartridge and arranged to have a progressive geometry such as disclosed in U.S. Pat. No. 6,212,777, the overall shaving experience becomes uncomfortable. It is believed that this is due to the fact that there is an overall acceptable shaving pressure level that may be applied against the skin. If the shaving pressure is too high, the skin will be irritated. In a razor cartridge with progressive geometry, the last blade having a positive exposure will lead to an unacceptable shaving pressure if the cutter force is too low.

It is desirable to provide a razor cartridge having blades with sharpened edges that does not produce an unacceptable shaving pressure applied to the skin of the user.

SUMMARY

A razor cartridge for a razor is provided. The razor cartridge comprises a guard, a cap, and at least two blades with parallel sharpened edges located between the guard and cap. A first blade defines a blade edge nearest the guard and a second blade defines a blade edge nearest the cap. The first blade has a cutter force less than the cutter force of the second blade.

Preferably the first blade has a cutter force at least about 5% less than the cutter force of the second blade. More preferably, the first blade has a cutter force at least about 10% less than the cutter force of the second blade.

The first blade may comprise a hard coating layer. The first blade may comprise an overcoat layer. The first blade may comprise an outer layer.

The second blade may comprise a hard coating layer. The second blade may comprise an overcoat layer. The second blade may comprise an outer layer.

The razor cartridge may comprise three blades with parallel sharpened edges with a third blade positioned between the first blade and the second blade. The razor cartridge may comprise four blades with parallel sharpened edges with two third blades positioned between the first blade and the second blade. The razor cartridge may comprise five blades with parallel sharpened edges with three third blades positioned between the first blade and the second blade. The razor cartridge may comprise six or more blades with the parallel sharpened edges with the first blade nearest the guard.

The substrate of the first blade edge has a tip having a radius of about 125 to 300 angstroms. The substrate of second blade edge has a tip having a radius of about 125 to 300 angstroms.

In a preferred embodiment, the first blade substrate has a thickness of between about 1.3 and 1.6 micrometers measured at a distance of four micrometers from the blade tip, a thickness of between about 2.2 and 2.7 micrometers measured at a distance of eight micrometers from the blade tip, a thickness of between about 3.8 and 4.9 micrometers measured at a distance of sixteen micrometers from the blade tip, a ratio of thickness at four micrometers to the thickness at eight micrometers of at least 0.45 and a ratio of thickness at four micrometers to the thickness at sixteen micrometers of at least 0.25. The second blade substrate has a thickness of greater than 1.6 micrometers measured at a distance of four micrometers from the blade tip, a thickness of greater than 2.7 micrometers measured at a distance of eight micrometers from the blade tip, and a thickness of greater than 4.9 micrometers measured at a distance of sixteen micrometers from the blade tip.

The second blade substrate has a ratio of thickness measured at four micrometers from the tip to the thickness measured at eight micrometers from the tip of less than 0.65 and a ratio of thickness measured at four micrometers from the tip to the thickness measured at sixteen micrometers from the tip of less than 0.35.

Cutter force is measured by the wool felt cutter test, which measures the cutter forces of the blade by measuring the force required by each blade to cut through wool felt. The cutter force of each blade is determined by measuring the force required by each blade to cut through wool felt. Each blade is run through the wool felt cutter 5 times and the force of each cut is measured on a recorder. The lowest of 5 cuts is defined as the cutter force.

Where a razor has multiple blades, one or more blades can be designed with reduced cutter forces while other blades can be designed to have higher cutter forces. This combination of different blades having differing cutter forces provides a shave having improved closeness while maintaining comfort.

DESCRIPTION OF DRAWINGS

While the specification concludes with claims particularly pointing out and distinctly claiming the subject matter that is regarded as the present invention, it is believed that the invention will be more fully understood from the following description taken in conjunction with the accompanying drawings.

DETAILED DESCRIPTION

Figure 1:
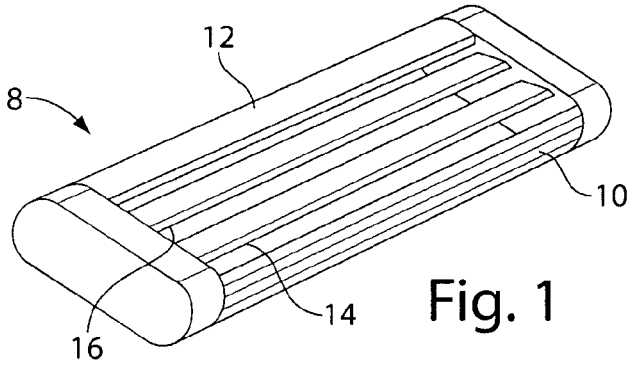
FIGS. 1-4 depict razor cartridges having multiple blades where one or more blades have relatively lower cutter forces than another blade positioned in the razor.

Referring to FIG. 1, a razor cartridge 8 includes a guard 10, a cap 12, and two blades 14 and 16. The first blade 14 has lower cutter forces than the second blade 16, and is positioned between the guard 10 and the second blade 16. Thus, when the razor cartridge 8 is in use, the first blade 14 will contact the hair before the second blade 16.

As used herein in both the text and the figures the term "first blade" refers to a blade having relatively lower cutter forces, which correspond to a lower frictional resistance than the blade referred to as the second blade. Likewise, the term second blade refers to a blade having relatively higher cutter forces, which correspond to a higher frictional resistance than the blade referred to as the first blade.

Figure 2:
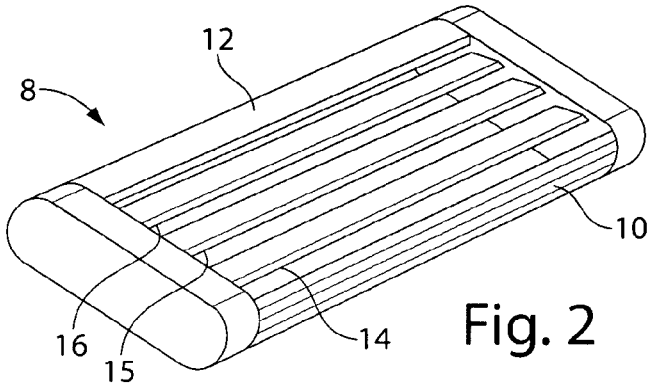
Figure 3:
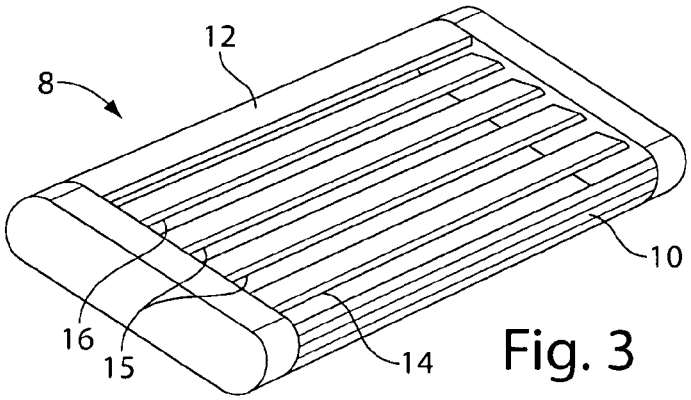
Figure 4:
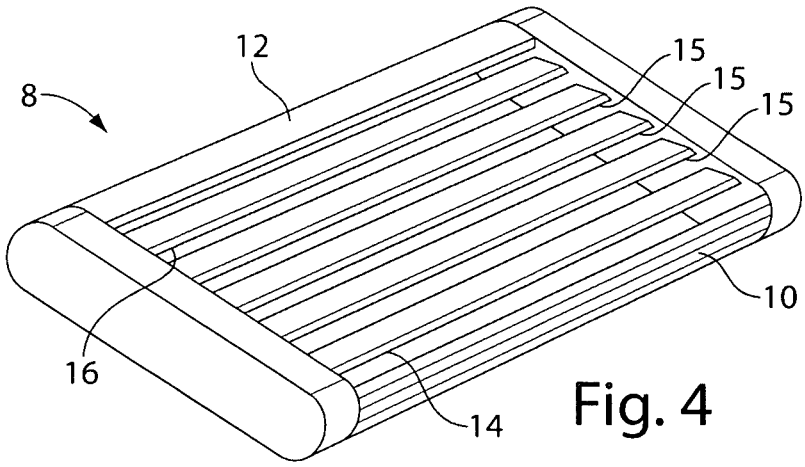

Referring to FIGS. 2-4, other razor cartridges can include a guard, a cap, and multiple blades (three, four, five or more blades respectively). In each instance a first blade 14 having lower cutter forces than a second blade 16 is positioned between a guard 10 and the second blade 16.

As depicted in FIG. 2, the razor cartridge 8 has three blades. The first blade 14 is the blade with the lower cutter forces and positioned closest to the guard 10 (i.e., in the principal position). The second blade 16 having the higher cutter forces is positioned in the third position from the guard 10, i.e., in the position nearest the cap 12. A third blade 15 is positioned between the first blade 14 and the second blade 16. The third blade 15 may be identical to the first blade 14, identical to the second blade 16, or have a configuration different from the first blade 14 and the second blade 16. Preferably, the third blade 15 is identical to the first blade 14.

As depicted in FIG. 3, the razor cartridge 8 can include four blades. The first blade 14 is the blade with lower cutter forces and positioned closest to the guard 10 (i.e., the principal position). The second blade 16 having higher cutter forces is positioned in the fourth position from the guard 10, i.e., in the position nearest the cap 12. Two third blades 15 are positioned between the first blade 14 and the second blade 16. The third blades 15 may be identical to the first blade 14, identical to the second blade 16, or have a configuration different from the first blade 14 and the second blade 16. Preferably, the third blades 15 are each identical to the first blade 14.

As depicted in FIG. 4, the razor cartridge 8 has five blades. The first blade 14 is the blade with lower cutter forces and positioned closest to the guard 10 (i.e., the principal position). The second blade 16 having higher cutter forces is positioned in the fifth position from the guard 10, i.e., in the position nearest the cap 12. Three third blades 15 are positioned between the first blade 14 and the second blade 16. The third blades 15 may be identical to the first blade 14, identical to the second blade 16, or have a configuration different from the first blade 14 and the second blade 16. Preferably, the third blades 15 are each identical to the first blade 14.

While razor cartridges have been shown with two, three, four and five blades, razor cartridges having six or more blades may also be desirable.

Preferably, the blades are arranged within the razor cartridge such that they have a progressive geometry. An example of a razor cartridges with blades arranged to have a progressive geometry is described in U.S. Pat. No. 6,212,777.

In some instances, the first blade has a cutter force at least 5% less than the cutter force of the second blade. Preferably, the first blade has a cutter force at least about 10% less than the cutter force of the second blade. In general, the cutter force of the first blade is between about 0.1 and 1.0 lbs. less than that of the second blade. Preferably, the first blade has a cutter force of at least about 0.2 lbs. less than that of the second blade.

Figure 5:
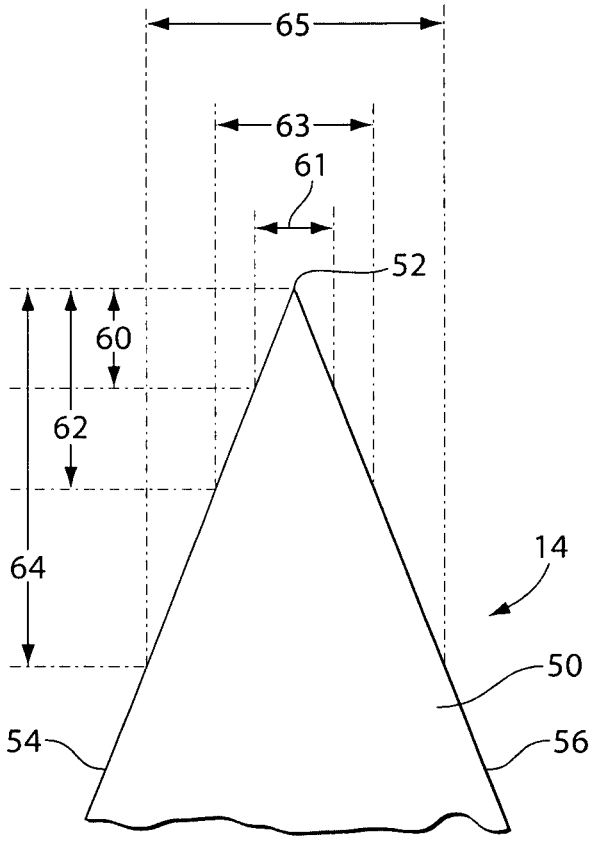
FIG. 5 is a diagrammatic view illustrating a first blade substrate.

Providing a blade having higher cutter forces can be accomplished by altering the shape of the blade itself. A diagrammatic view of an edge region of the first blade 14 is shown in FIG. 5. The first blade 14 includes stainless steel body portion or substrate 50 with a wedge-shaped sharpened edge having a tip 52. Tip 52 preferably has a radius of from about 125 to 300 angstroms with facets 54 and 56 that diverge from tip 52. The substrate 50 has a thickness 61 of between about 1.3 and 1.6 micrometers measured at a distance 60 of four micrometers from the blade tip 52. The substrate 50 has a thickness 63 of between about 2.2 and 2.7 micrometers measured at a distance 62 of eight micrometers from the blade tip 52. The substrate 50 has a thickness 65 of between about 3.8 and 4.9 micrometers measured at a distance 64 of sixteen micrometers from the blade tip 52.

The substrate 50 has a ratio of thickness 61 measured at four micrometers from the tip 52 to the thickness 63 measured at eight micrometers from the tip 52 of at least 0.45. The substrate 50 has a ratio of thickness 61 measured at four micrometers from the tip 52 to the thickness 65 measured at sixteen micrometers from the tip 52 of at least 0.25.

Figure 6:
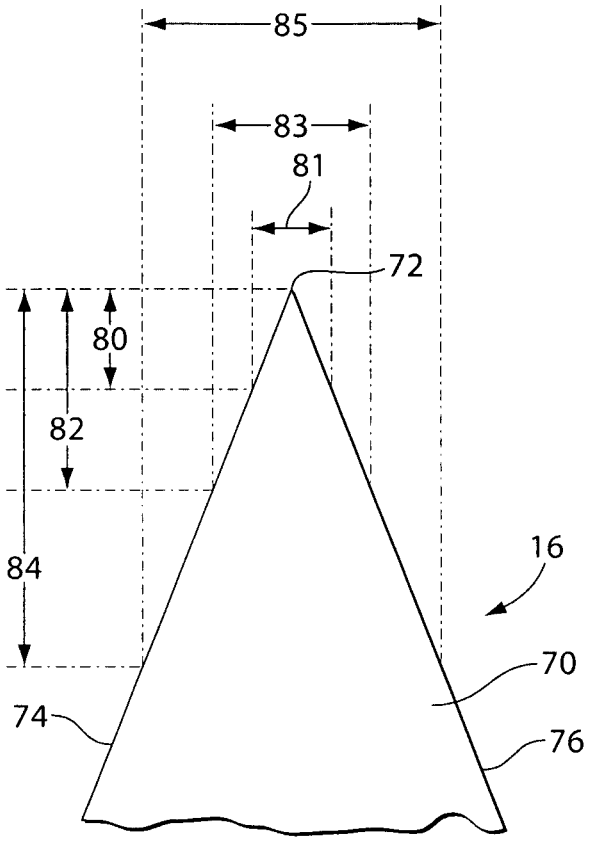
FIG. 6 is a diagrammatic view illustrating a second blade substrate.

A diagrammatic view of an edge region of the second blade 16 is shown in FIG. 6. The second blade 16 includes stainless steel body portion or substrate 70 with a wedge-shaped sharpened edge having a tip 72. Tip 72 preferably has a radius of from about 125 to 300 angstroms with facets 74 and 76 that diverge from tip 72. The substrate 70 has a thickness 81 of greater than 1.6 micrometers measured at a distance 80 of four micrometers from the blade tip 72. The substrate 70 has a thickness 83 of greater than 2.7 micrometers measured at a distance 82 of eight micrometers from the blade tip 72. The substrate 70 has a thickness 85 of greater than 4.9 micrometers measured at a distance 84 of sixteen micrometers from the blade tip 72.

The substrate 70 has a ratio of thickness 81 measured at four micrometers from the tip to the thickness 83 measured at eight micrometers from the tip of less than 0.65. The substrate 70 has a ratio of thickness 81 measured at four micrometers from the tip to the thickness 85 measured at sixteen micrometers from the tip of less than 0.35.

The thicknesses and ratios of thicknesses provide a framework for improved shaving. The thicknesses and ratios of thickness provide a balance between edge strength and low cutting force or sharpness. A substrate having smaller ratios will have inadequate strength leading to ultimate edge failure. A substrate having greater thicknesses will have a higher cutting force leading to an increased tug and pull and increased discomfort for the user during shaving.

One substrate 11 material which may facilitate producing an appropriately sharpened edge is a martensitic stainless steel with smaller more finely distributed carbides, but with similar overall carbon weight percent. A fine carbide substrate provides for a harder and more brittle after-hardening substrates, and enables the making of a thinner, stronger edge. An example of such a substrate material is a martensitic stainless steel with a finer average carbide size with a carbide density of at least about 200 carbides per square micrometer, more preferably at least about 300 carbides per square micrometer, and most preferably at least about 400 carbides or more per 100 square micrometers as determined by optical microscopic cross-section.

Figure 7:
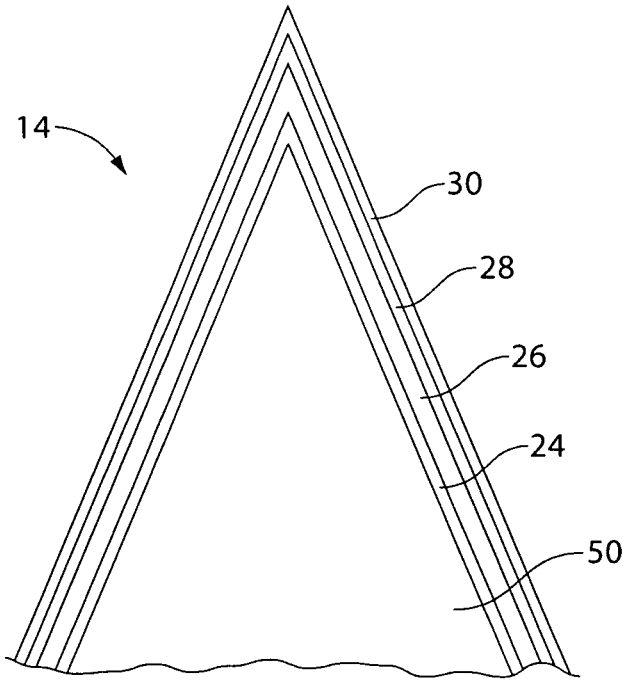
FIG. 7 is a diagrammatic view illustrating a first blade.

Referring now to FIG. 7, there is shown a finished first blade 14 including substrate 50, interlayer 24, hard coating layer 26, overcoat layer 28, and outer layer 30. The substrate 50 is typically made of stainless steel though other materials can be employed. An example of a razor blade having a substrate, interlayer, hard coating layer, overcoat layer and an outer layer is described in U.S. Pat. No. 6,684,513.

Interlayer 24 is used to facilitate bonding of the hard coating layer 26 to the substrate 50. Examples of suitable interlayer material are niobium, titanium and chromium containing material. A particular interlayer is made of niobium greater than about 100 angstroms and preferably less than about 500 angstroms thick. The interlayer may have a thickness from about 150 angstroms to about 350 angstroms. PCT 92/03330 describes use of a niobium interlayer.

Hard coating layer 26 provides improved strength, corrosion resistance and shaving ability and can be made from fine-, micro-, or nano-crystalline carbon containing materials (e.g., diamond, amorphous diamond or DLC), nitrides (e.g., boron nitride, niobium nitride, chromium nitride, zirconium nitride, or titanium nitride), carbides (e.g., silicon carbide), oxides (e.g., alumina, zirconia) or other ceramic materials (including nanolayers or nanocomposites). The carbon containing materials can be doped with other elements, such as tungsten, titanium, silver or chromium by including these additives, for example in the target during application by sputtering. The materials can also incorporate hydrogen, e.g., hydrogenated DLC. Preferably coating layer 26 is made of diamond, amorphous diamond or DLC. A particular embodiment includes DLC less than 3,000 angstroms, preferably from about 500 angstroms to about 1,500 angstroms. DLC layers and methods of deposition are described in U.S. Pat. No. 5,232,568. As described in the "Handbook of Physical Vapor Deposition (PVD) Processing, "DLC is an amorphous carbon material that exhibits many of the desirable properties of diamond but does not have the crystalline structure of diamond."

Overcoat layer 28 is used to reduce the tip rounding of the hard coated edge and to facilitate bonding of the outer layer to the hard coating while still maintaining the benefits of both. Overcoat layer 28 is preferably made of chromium containing material, e.g., chromium or chromium alloys or chromium compounds that are compatible with polytetrafluoroethylene, e.g., CrPt. A particular overcoat layer is chromium about 100-200 angstroms thick. Overcoat layer may have a thickness of from about 50 angstroms to about 500 angstroms, preferably from about 100 angstroms to about 300 angstroms. First blade 14 has a cutting edge that has less rounding with repeated shaves than it would have without the overcoat layer.

Outer layer 30 is used to provide reduced friction. The outer layer 30 may be a polymer composition or a modified polymer composition. The polymer composition may be polyfluorocarbon. A suitable polyfluorocarbon is polytetrafluoroethylene sometimes referred to as a telomer. A particular polytetrafluoroethylene material is Krytox LW 1200 available from DuPont. This material is a nonflammable and stable dry lubricant that consists of small particles that yield stable dispersions. It is furnished as an aqueous dispersion of 20% solids by weight and can be applied by dipping, spraying, or brushing, and can thereafter be air dried or melt coated. The layer is preferably less than 5,000 angstroms and could typically be 1,500 angstroms to 4,000 angstroms, and can be as thin as 100 angstroms, provided that a continuous coating is maintained. Provided that a continuous coating is achieved, reduced telomer coating thickness can provide improved first shave results. U.S. Pat. Nos. 5,263,256 and 5,985,459, which are hereby incorporated by reference, describe techniques which can be used to reduce the thickness of an applied telomer layer.

First blade 14 is made generally according to the processes described in the above referenced patents. A particular embodiment includes a niobium interlayer 24, DLC hard coating layer 26, chromium overcoat layer 28, and Krytox LW1200 polytetrafluoroethylene outer coat layer 30. Chromium overcoat layer 28 is deposited to a minimum of 100 angstroms and a maximum of 500 angstroms. It is deposited by sputtering using a DC bias (more negative than −50 volts and preferably more negative than −200 volts) and pressure of about 2 millitorr argon. The increased negative bias is believed to promote a compressive stress (as opposed to a tensile stress), in the chromium overcoat layer which is believed to promote improved resistance to tip rounding while maintaining good shaving performance. First blade 14 preferably has a tip radius of about 200-400 angstroms, measured by SEM after application of overcoat layer 28 and before adding outer layer 30.

Figure 8:
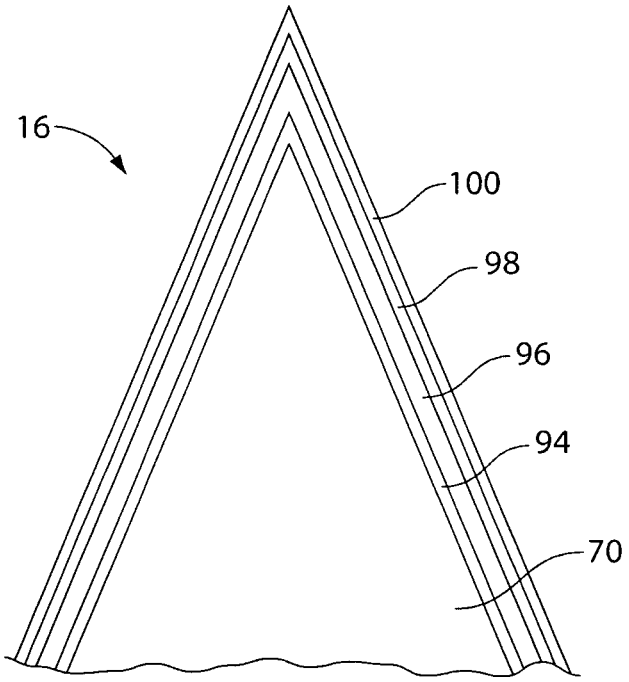
FIG. 8 is a diagrammatic view illustrating a second blade.

Referring now to FIG. 8, there is shown a finished second blade 16 including substrate 70, interlayer 94, hard coating layer 96, overcoat layer 98, and outer layer 100. The substrate 70 is typically made of stainless steel though other materials can be employed. An example of a razor blade having a substrate, interlayer, hard coating layer, overcoat layer and an outer layer is described in U.S. Pat. No. 6,684,513.

Interlayer 94 is used to facilitate bonding of the hard coating layer 96 to the substrate 70. Examples of suitable interlayer material are niobium, titanium and chromium containing material. A particular interlayer is made of niobium greater than about 100 angstroms and preferably less than about 500 angstroms thick. The interlayer may have a thickness from about 150 angstroms to about 350 angstroms. PCT 92/03330 describes use of a niobium interlayer.

Hard coating layer 96 provides improved strength, corrosion resistance and shaving ability and can be made from fine-, micro-, or nano-crystalline carbon containing materials (e.g., diamond, amorphous diamond or DLC), nitrides (e.g., boron nitride, niobium nitride, chromium nitride, zirconium nitride, or titanium nitride), carbides (e.g., silicon carbide), oxides (e.g., alumina, zirconia) or other ceramic materials (including nanolayers or nanocomposites). The carbon containing materials can be doped with other elements, such as tungsten, titanium, silver or chromium by including these additives, for example in the target during application by sputtering. The materials can also incorporate hydrogen, e.g., hydrogenated DLC. Preferably coating layer 96 is made of diamond, amorphous diamond or DLC. A particular embodiment includes DLC less than about 1,500 angstroms, preferably from about 400 angstroms to about 1,000 angstroms. DLC layers and methods of deposition are described in U.S. Pat. No. 5,232,568. As described in the "Handbook of Physical Vapor Deposition (PVD) Processing, "DLC is an amorphous carbon material that exhibits many of the desirable properties of diamond but does not have the crystalline structure of diamond.

Overcoat layer 98 is used to reduce the tip rounding of the hard coated edge and to facilitate bonding of the outer layer to the hard coating while still maintaining the benefits of both. Overcoat layer 98 is preferably made of chromium containing material, e.g., chromium or chromium alloys or chromium compounds that are compatible with polytetrafluoroethylene, e.g., CrPt. A particular overcoat layer is chromium about 100-200 angstroms thick. Overcoat layer may have a thickness of from about 50 angstroms to about 500 angstroms, preferably from about 100 angstroms to about 300 angstroms. Second blade 16 has a cutting edge that has less rounding with repeated shaves than it would have without the overcoat layer.

Outer layer 100 is used to provide reduced friction. The outer layer 100 may be a polymer composition or a modified polymer composition. The polymer composition may be polyfluorocarbon. A suitable polyfluorocarbon is polytetrafluoroethylene sometimes referred to as a telomer. A particular polytetrafluoroethylene material is Krytox LW 1200 available from DuPont. This material is a nonflammable and stable dry lubricant that consists of small particles that yield stable dispersions. It is furnished as an aqueous dispersion of 20% solids by weight and can be applied by dipping, spraying, or brushing, and can thereafter be air dried or melt coated. The layer is preferably less than 5,000 angstroms and could typically be 1,500 angstroms to 4,000 angstroms, and can be as thin as 100 angstroms, provided that a continuous coating is maintained. Provided that a continuous coating is achieved, reduced telomer coating thickness can provide improved first shave results. U.S. Pat. Nos. 5,263,256 and 5,985,459, which are hereby incorporated by reference, describe techniques which can be used to reduce the thickness of an applied telomer layer.

Second blade 16 is made generally according to the processes described in the above referenced patents. A particular embodiment includes a niobium interlayer 94, DLC hard coating layer 96, chromium overcoat layer 98, and Krytox LW1200 polytetrafluoroethylene outer coat layer 100. Chromium overcoat layer 98 is deposited to a minimum of 100 angstroms and a maximum of 500 angstroms. It is deposited by sputtering using a DC bias (more negative than −50 volts and preferably more negative than −200 volts) and pressure of about 2 millitorr argon. The increased negative bias is believed to promote a compressive stress (as opposed to a tensile stress), in the chromium overcoat layer which is believed to promote improved resistance to tip rounding while maintaining good shaving performance. Second blade 16 preferably has a tip radius of about 200-400 angstroms, measured by SEM after application of overcoat layer 98 and before adding outer layer 100.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

All documents cited in the Detailed Description of the Invention are, in relevant part, incorporated herein by reference; the citation of any document is not to be construed as an admission that it is prior art with respect to the present invention. To the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A razor cartridge comprising:

a guard, a cap, and at least two blades with parallel sharpened edges located between the guard and cap, a first blade defining a blade edge nearest the guard and a second blade defining a blade edge nearest the cap, wherein the first blade has a cutter force less than the cutter force of the second blade, said first blade comprising a substrate having a thickness of between about 1.3 and 1.6 micrometers at a distance of four micrometers from the blade tip, a thickness of between about 2.2 and 2.7 micrometers at a distance of eight micrometers from the blade tip, a thickness of between about 3.8 and 4.9 micrometers at a distance of sixteen micrometers from the blade tip, a ratio of thickness at four micrometers to the thickness at eight micrometers of at least 0.45 and a ratio of thickness at four micrometers to the thickness at sixteen micrometers of at least 0.25; and said second blade comprising a substrate having a thickness of greater than 1.6 micrometers at a distance of four micrometers from the blade tip, a thickness of greater than 2.7 micrometers at a distance of eight micrometers from the blade tip, a thickness of greater than 4.9 micrometers at a distance of sixteen micrometers from the blade tip.

2. The razor cartridge of claim 1 wherein the first blade has a cutter force at least about 5% less than the cutter force of the second blade.

3. The razor cartridge of claim 1 wherein said first blade substrate edge has a tip having a radius of about 125 to 300 angstroms and said second blade substrate edge has a tip having a radius of about 125 to 300 angstroms.

4. The razor cartridge of claim 1 wherein the second blade substrate has a ratio of thickness at four micrometers to the thickness at eight micrometers of less than 0.65 and a ratio of thickness at four micrometers to the thickness at sixteen micrometers of less than 0.35.

5. The razor cartridge of claim 1 wherein the first blade has a cutter force at least about 10% less than the cutter force of the second blade.

6. The razor cartridge of claim 1 wherein the first blade comprises a hard coating layer.

7. The razor cartridge of claim 1 wherein the first blade comprises an overcoat layer.

8. The razor cartridge of claim 1 wherein the first blade comprises an outer layer.

9. The razor cartridge of claim 1 further comprising a third blade positioned between the first blade and the second blade.

10. The razor cartridge of claim 9 further comprising an additional third blade positioned between the first blade and the second blade.

11. The razor cartridge of claim 10 further comprising an additional third blade positioned between the first blade and the second blade.

* * * * *